US006532737B1

(12) United States Patent
Kozerski et al.

(10) Patent No.: US 6,532,737 B1
(45) Date of Patent: Mar. 18, 2003

(54) EXHAUST PORT GASKET WITH CYLINDER-SPECIFIC ELECTRONIC OXYGEN SENSORS

(75) Inventors: Richard J. Kozerski, Lisle, IL (US); Ernest Oxenknecht, Downers Grove, IL (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/943,824

(22) Filed: Aug. 30, 2001

(51) Int. Cl.[7] ..... F01N 7/10
(52) U.S. Cl. ..... 60/323
(58) Field of Search ..... 60/323, 276; 123/23.32, 123/703

(56) References Cited

U.S. PATENT DOCUMENTS

| | | | | |
|---|---|---|---|---|
| 2,775,234 A | | 12/1956 | Smits | |
| 2,904,610 A | | 9/1959 | Morrison | |
| 3,994,270 A | * | 11/1976 | Nakano et al. | 123/184.41 |
| 4,364,226 A | * | 12/1982 | Croset et al. | 204/400 |
| 4,393,687 A | | 7/1983 | Müller et al. | |
| 4,397,176 A | | 8/1983 | Rohde et al. | |
| 4,425,788 A | | 1/1984 | Franke et al. | |
| 4,436,068 A | | 3/1984 | Nakamura et al. | |
| 4,470,392 A | | 9/1984 | Yoshinaga et al. | |
| 4,525,140 A | | 6/1985 | Larigaldie et al. | |
| 4,660,535 A | | 4/1987 | Asano | |
| 4,686,861 A | | 8/1987 | Morii | |
| 4,774,922 A | | 10/1988 | Morita | |
| 4,947,680 A | | 8/1990 | McDougal | |
| 4,996,873 A | | 3/1991 | Takeuchi | |
| 5,046,466 A | | 9/1991 | Lipski | |
| 5,066,023 A | | 11/1991 | Ma | |
| 5,121,929 A | | 6/1992 | Cobb | |
| 5,195,365 A | | 3/1993 | Chujo et al. | |
| 5,230,238 A | | 7/1993 | Takeuchi | |
| 5,380,014 A | | 1/1995 | Schäperkötter | |
| 5,421,594 A | * | 6/1995 | Becerra | 277/608 |
| 5,626,348 A | * | 5/1997 | Takada et al. | 277/593 |
| 5,659,132 A | | 8/1997 | Novak et al. | |
| 5,712,422 A | * | 1/1998 | Kato | 73/116 |
| 5,791,659 A | * | 8/1998 | Takada et al. | 277/593 |
| 5,804,712 A | | 9/1998 | Staerzl | |
| 6,161,510 A | | 12/2000 | Ishikawa et al. | |

OTHER PUBLICATIONS

"Investigation of In–Cylinder Fluid Motion Using A Head Gasket Instrumented with Ionization Probes," Witze, et al. SAE Technical Paper Series 9101719, pp. 1–15 (1991).

"Multipoint Spark Ignition for Lean Combustion," Nakamura, et al. SAE Technical Paper Series 852092, pp. 1–10 (1985).

* cited by examiner

*Primary Examiner*—Thomas Denion
*Assistant Examiner*—Diem Tran
(74) *Attorney, Agent, or Firm*—Rader, Fishman & Grauer PLLC

(57) ABSTRACT

An exhaust port gasket is adapted for insertion between an engine exhaust port and an exhaust pipe flange for sealing therebetween. The gasket includes at least one primary aperture acting as an exhaust port for accommodating flows of exhaust gases, and includes at least one electronic oxygen sensor responsive to oxygen levels of gases passing through the exhaust port. To the extent that oxygen-sensing is provided at the exhaust port, improved real time engine management may be derived from cylinder-by-cylinder measurements of the oxygen levels by inputting the measurements into an engine control unit module to optimize engine performance parameters, including fuel economy and emissions levels. In one described embodiment, a plurality of cylindrical oxygen sensor probes are positioned in surface grooves of a spacer layer of the exhaust gasket, and individual probe sensor wires are collectively connected to a wire harness portion of the gasket.

12 Claims, 2 Drawing Sheets

EXHAUST PORT GASKET WITH CYLINDER-SPECIFIC ELECTRONIC OXYGEN SENSORS

BACKGROUND OF THE INVENTION

1. Field of Invention

The present invention relates generally to sensing apparatus embedded in and or applied to gasket structures, and particularly to apparatus applied to exhaust gaskets of internal combustion engines. More specifically, the invention relates to electronic oxygen sensor apparatus provided within structures of exhaust gaskets for measuring oxygen levels in gaseous exhaust media passing through apertures of such gaskets.

2. Description of the Prior Art

It is known to employ electronic sensors in gaskets for sealing between engine components including, for example, the block and cylinder head of a multi-cylinder internal combustion engine. In one case, the gasket comprises a sealing plate having several combustion chamber orifices, with combustion chamber sealing elements situated on the edges of the sealing plate surrounding the combustion chamber orifices. The gasket includes sensor elements for cylinder-specific detection of sealing movements perpendicular to the plane of the sealing plate, caused by pressure changes in respective combustion chambers being measured. All of the sensor elements are arranged outside of the combustion chamber sealing elements, and can be piezoelectric and piezoresistive, as well as glass fiber light guide-style sensors.

In another example, a gasket enclosed sensor system is employed for measurement of combustion chamber parameters and delivery of signals to points external of the engine. The gasket includes a combustion opening substantially surrounding a combustion chamber, and includes an access opening extending from the combustion chamber to a point external of the engine. A metallic sensor terminal is positioned within the access opening, and insulating material substantially surrounds the metallic sensor terminal.

In yet another example, a fluid sensor and associated circuitry are used to indicate presence of oil flow in a multi-cylinder internal combustion engine. The oil sensor includes a heating element positioned within the oil line, directly in the oil flow path. A comparator measures the value of signals from upstream and downstream heat sensors, and triggers a switching circuit when the temperature at the sensors approach one another to indicate an adequate oil flow to the engine.

In still another example, a gasket formed in the shape of an exhaust flange includes a load sensor comprising a pressure sensitive electrically resistive material positioned between electrodes and conductors extending outwardly of the perimeter of the gasket. A seal provided between first and second layers of the gasket, and about the load sensor, provides a seal for the electrodes, which are positioned in a cavity to protect the sensor from fluids.

SUMMARY OF THE INVENTION

The present invention provides an electronic oxygen sensor for an automotive exhaust port gasket adapted for insertion between mating surfaces of an engine exhaust port and an exhaust pipe flange for sealing therebetween. The gasket includes at least one primary aperture for accommodating the flow of exhaust gases, and includes at least one electronic oxygen sensor responsive to oxygen levels of the gases passing through said exhaust port. Where a plurality of ports are provided in the gasket, and to the extent that oxygen-sensing is provided at each exhaust port, a real time quality engine management control opportunity based upon cylinder-by-cylinder measurements of said oxygen levels is provided. The specific cylinder-to-cylinder oxygen sensing data can be input into an engine control unit module that includes systems for optimization of engine performance parameters, including fuel economy and emissions levels.

The oxygen sensor is designed to be applied to or embedded within a spacer layer positioned between the beaded or active layers of a multiple-layered steel exhaust port gasket. The oxygen sensor is positioned to be particularly effective to measure changes in oxygen levels of cylinder-specific exhaust gases passing through the primary apertures of the gasket. In this way, a real-time control feedback loop may be established for controlling air-fuel mixtures for optimizing engine combustion parameters, compared to the standard oxygen sensor placement at an exhaust point downstream of the individual exhaust ports.

In the disclosed embodiment, the oxygen sensor system includes a sensing element carried or formed as part of a spacer layer of an exhaust manifold gasket.

DETAILED DESCRIPTION OF THE PREFERRED EMBODIMENTS

Figure 1:
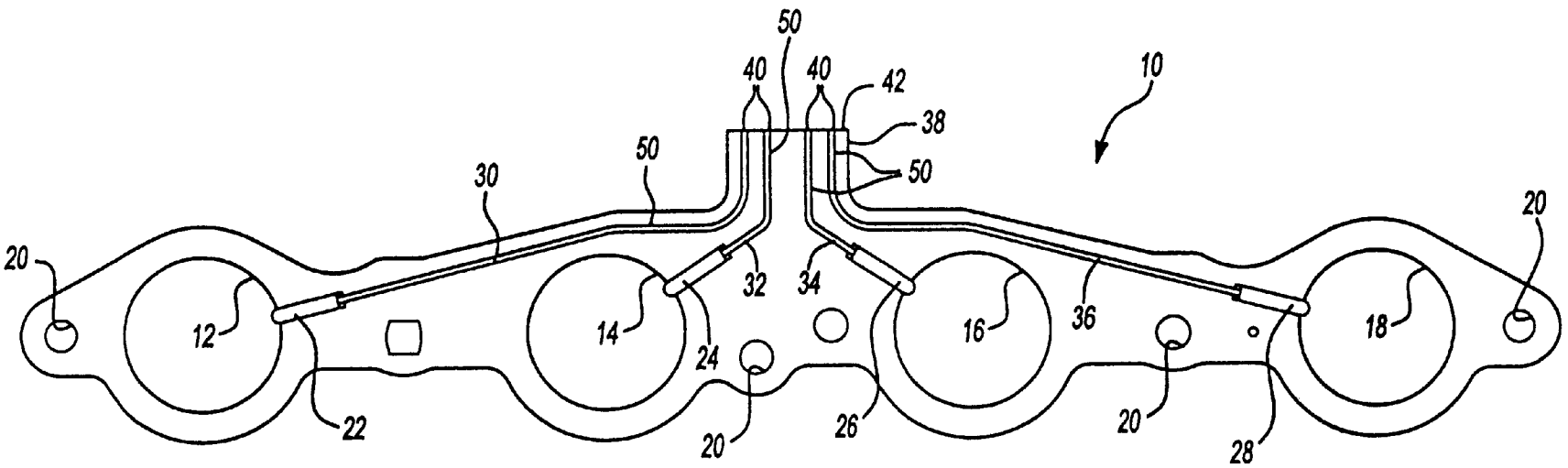
FIG. 1 is a plan view of a spacer layer of one described embodiment of an exhaust gasket that incorporates the oxygen sensor system of the present invention, each sensor defined by a cylindrical probe disposed within a surface groove provided in a spacer layer of the gasket, and positioned to protrude slightly into an exhaust gas port aperture.

Referring initially to FIG. 1, one described embodiment of an exhaust gasket 10 is shown, including a plurality of spaced cylinder head exhaust ports 12, 14, 16, and 18. The described gasket 10 is a multi-layer steel (MLS) gasket, although this invention is not limited only to so-called MLS gaskets. The gasket 10 also includes a plurality of similarly spaced bolt apertures 20. A plurality of oxygen sensors 22, 24, 26, and 28 are adapted to interface the edges of each of the cylinder head exhaust ports 12, 14, 16, and 18, respectively.

Each of the oxygen sensors 22, 24, 26, and 28 has an integral connection to one of the individual sensor connection wires 30, 32, 34, and 36, respectively. All respective sensor connection wires converge together at, and are attached to, a wire harness portion 38 of the gasket 10. The ends 40 of the sensor connection wires collectively terminate along an edge 42 of the harness portion 38 as shown, and are adapted to be engaged by an electrical harness clip (not shown) that is secured rigidly to the wire harness portion 38 for facilitating transmittal of electrical data to an electronic engine control unit (ECU) not shown. It is envisioned that the ECU will read the relevant oxygen sensor data, and make adjustments to time-responsive engine controls in response to cylinder-specific levels of oxygen indicated.

Figure 2:
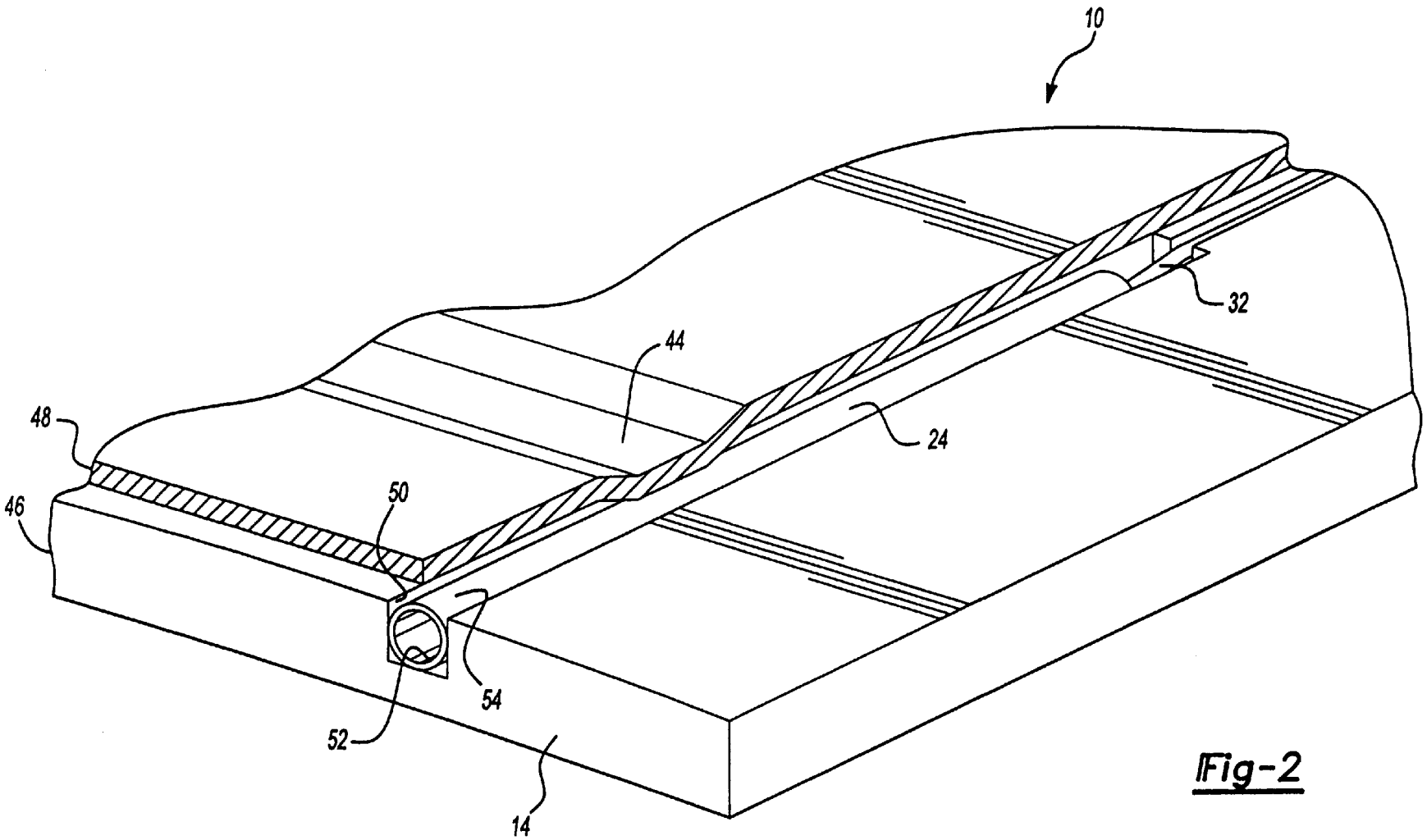
FIG. 2 is an enlarged perspective break-away view of a portion of the gasket of the present invention to reveal details of a groove provided in the surface of an exhaust gasket spacer layer, showing an oxygen sensor probe positioned in the groove and cut open to reveal the cylindrical nature of the probe.

Referring now to FIG. 2, a fragmentary portion of one of the cylinder head exhaust ports, i.e. port 14, is depicted on an enlarged scale to show details of one representative individual oxygen sensor 24, and its associated sensor connection wire 32. A spacer layer 46 is adapted to be positioned against at least one beaded metallic layer 48 as shown, and is ideally positioned between two of such beaded layers. The beaded layer 48 has at least one resilient beaded 44, adapted for assuring positive sealing, as will be appreciated by those skills in the art. Two of such beaded layers 48 are preferably employed, the layers 48 sandwiching the spacer layer 46. Ideally, the beads 44 are positioned symmetrically on the layers 48 so as to form mirrored images of one another.

The spacer layer 46 includes an elongated groove 50 in the surface of the layer 46. The groove 50 has a surface depth equal to the outside dimension of the oxygen sensor 24. The groove may be machined or stamped into the layer 46, as the layer is of carbon steel metal.

The beaded layers 48 in the embodiment described herein are formed of spring steel, e.g. stainless steel. The spacer layer 46, sandwiched between layers 48, is also formed of steel, but since without resilient beads may be formed of a lesser quality steel, such as plain carbon steel. Alternatively, the spacer layer 46 may be formed of an insulating nonmetallic material resistant to high temperatures. For example, granulated vermiculite provides one such alternative material for the manufacture of the layer 46, wherein the vermiculite would be applied to a clinched or perforated metal core. The resultant composite layer 46 would offer superior heat insulating properties, in addition to readily accommodating formation of the grooves 50 in the surface of the layer 46.

Each sensor is formed in the nature of a probe, and includes an interior cylindrical wall 52 and an exterior cylindrical wall 54. The sensor body is formed of a ceramic; the interior and exterior cylindrical walls 52, 54 thereof are coated in accordance with principles of oxygen sensing art, and may include a composition of zirconium oxide. Typically, when the sensor reaches its operating temperature, typically around 300° C., a voltage is generated which has a value that is a function of the amount of oxygen present in the gases being measured. To the extent that oxygen sensor art is well established, however, the precise methods of sensing are beyond the scope of this invention.

In the described embodiment, the manner of affixation of the oxygen sensors and the sensor connection wires to the layer 46 is such that the sensors and wires are fully disposed within their respective grooves 50. A bonding agent, such as an epoxy or high temperature adhesive, may also be used to assure reliable affixation of the sensors 22, 24, 26, 28 in their grooves during manufacture of the gasket. Of course, the same or similar affixation technique would be applied to the sensor connection wires 30, 32, 34, and 36.

It is to be understood that the above description is intended to be illustrative and not limiting. Many embodiments will be apparent to those of skill in the art upon reading the above description. For example, a gasket within the sensor elements and wires molded into the body of the gasket material would fall within the broader scope of this invention. Therefore, the scope of the invention should be determined, not with reference to the above description, but instead with reference to the appended claims, along with the full scope of equivalents to which such claims are entitled.

What is claimed is:

1. An exhaust port gasket adapted for insertion between mating surfaces of an engine exhaust port and an exhaust pipe flange for sealing therebetween, said gasket comprising at least one port aperture for accommodating a flow of exhaust gases therethrough, said gasket further comprising at least one electronic oxygen sensor and sensor connection wire connected to a real-time engine management system, said oxygen sensor and sensor connection wire maintained within a groove formed within said gasket, said groove being open along a first surface of said gasket, wherein said oxygen sensor is responsive to oxygen levels of said exhaust gases passing through said engine exhaust port, and wherein oxygen-sensing is provided at each exhaust port for transmittal of cylinder-specific oxygen level data to said real-time engine management system for optimization of engine performance parameters.

2. The exhaust port gasket of claim 1, wherein said real-time engine management system includes optimization of fuel economy and emissions levels.

3. The exhaust port gasket of claim 2, further comprising a sensor connection wire integrally attached to said electronic oxygen sensor for accommodating said transmittal of said cylinder-specific oxygen level data to said real-time engine management system.

4. The exhaust port gasket of claim 3 wherein said exhaust port gasket comprises at least one beaded layer and one flat spacer layer, wherein each of said layers comprises at least one port aperture, and wherein said apertures are concentrically registered with each other in said respective layers, and wherein said groove comprises a surface groove maintained within said spacer layer and adapted to receive both said oxygen sensor and said sensor connection wire.

5. The exhaust port gasket of claim 3 wherein said exhaust port gasket comprises a pair of beaded layers, each having at least one bead, and one spacer layer, said spacer layer being sandwiched between said pair of beaded layers, wherein each of said layers comprises at least one port aperture, and wherein said apertures are symmetrically registered with each other in said respective layers, and wherein said spacer layer comprises a surface groove adapted to receive both said oxygen sensor and said sensor connection wire.

6. The exhaust port gasket of claim 5, wherein said beads of said beaded layers are positioned symmetrically on said respective beaded layers so as to comprise mirrored images of one another.

7. The exhaust port gasket of claim 6 comprising a plurality of said port apertures spaced apart from one another within said gasket, each of said ports comprising one of said oxygen sensors responsive to said oxygen levels of said exhaust gases passing through that one exhaust port, each sensor positioned at an edge of its respective exhaust port.

8. The exhaust port gasket of claim 7 further comprising a harness portion, wherein each of said sensor connection wires terminates at an edge of said harness portion.

9. The exhaust port gasket of claim 8 wherein said spacer layer is formed of a nonmetallic insulating material.

10. The exhaust port gasket of claim 9, wherein said spacer layer comprises a vermiculite material.

11. The exhaust port gasket of claim 10 wherein said vermiculite material is applied to a perforated metal core, and wherein said vermiculite material is granulated for facilitating its application to said core.

12. The exhaust port gasket of claim 11 wherein each of said sensors defines a cylindrical body, and wherein each of said grooves comprises a surface depth at least equal to the outside dimension of said oxygen sensor, such that said sensor may be substantially received within said groove.

* * * * *